US005404603A

United States Patent [19]

Fukai et al.

[11] Patent Number: 5,404,603

[45] Date of Patent: Apr. 11, 1995

[54] OSCILLATING BED

[75] Inventors: Koushiro Fukai, Atsugi; Yoshihisa Yamamoto, Yokohama; Yoji Shimura, Shinagawa; Kenji Takagi, Koutou, all of Japan

[73] Assignee: Nishikawa Sangyo Co., Ltd., Tokyo, Japan

[21] Appl. No.: 95,714

[22] Filed: Jul. 21, 1993

[30] Foreign Application Priority Data

Nov. 9, 1992 [JP] Japan ..... 4-083669 U

[51] Int. Cl.[6] ..... A61G 7/008; A61G 7/012

[52] U.S. Cl. ..... 5/609; 5/611; 601/90; 601/100

[58] Field of Search ..... 5/109, 609, 600, 11, 5/611; 601/25, 98, 26, 49, 98, 115

[56] References Cited

U.S. PATENT DOCUMENTS

| | | | |
|---|---|---|---|
| 2,076,675 | 4/1937 | Sharp | 5/609 |
| 4,028,753 | 6/1977 | Rios | 5/109 |
| 4,432,353 | 2/1984 | Vrzalik | 5/609 |
| 4,586,492 | 5/1986 | Manahan | 5/109 |

*Primary Examiner*—Alexander Grosz

*Attorney, Agent, or Firm*—Spensley Horn Jubas & Lubitz

[57] ABSTRACT

A bedding supporting floor is supported on a stationary frame supported on a base having castors through a lifting device so that the bedding supporting floor is oscillated about an oscillation shaft provided on a center axis thereof, and an oscillation device for oscillating the bedding supporting floor with respect to the stationary frame is provided. A plate-like bearing member having a circular arc edge provided on a head portion and a foot portion of the bedding supporting floor is placed on a pair of rolls supported on the stationary frame.

3 Claims, 1 Drawing Sheet

OSCILLATING BED

BACKGROUND OF THE INVENTION

1. Field of the Invention

The present invention relates to a bed capable of tilting or oscillating a bedding support platform for supporting bedding, such as a mattress.

2. Prior Art

Known bed frames are stationary. A plate spring or a platform material such as a board is placed on the bed frame, upon which bedding such as a mattress is placed.

To prevent the body from being unstable when the upper half of the sleeper's body is raised on the bed, beds have been designed in which the upper half portion of the platform material may be bent and raised. Beds have also been designed in which the lower half portion of the platform material can be bent and raised. These beds are convenient to allow the body to sit up or bend on the bed. However, these beds are not useful when a patient is being cared for in bed or when the body of the patient must be turned on the bed because of bedsores.

SUMMARY OF THE INVENTION

In view of the foregoing, an object of the present invention is to provide a bed in which, when the body of a patient is turned or when a bed sheet or the like is replaced, the body's direction can be easily turned, and in which a motion by which both left and right sides of a sleeper are alternately raised is imparted so that the body part to which the largest weight is applied when a sleeper is in bed is changed to prevent occurrence of bedsores.

A bedding support platform is supported on a stationary frame which is supported on a base having castors through a lifting device. The bedding support platform is oscillated about an oscillation shaft provided on a center axis thereof. An oscillation device for oscillating the bedding support platform with respect to the stationary frame is provided. Further, a plate-like supporting member having a circular edge is provided at the head and foot portions of the bedding support platform, respectively. A pair of rollers which are supported on the stationary frame are spaced apart from each other, and the bedding support platform is pivotally supported on the stationary frame.

When the sleeper's body is in contact with the bedding and the position of the portion to which the largest weight is applied is changed, a repeated oscillating motion for a long period of time is imparted to the bedding support platform. That is, when an oscillation motor is turned on to rotate a disk provided on the motor shaft and apply a reciprocating stroke to a supporting member of the bedding support platform through a connecting rod, the bedding support platform repeats the oscillation by which both the left and right sides thereof alternately move up and down about the oscillation shaft since the supporting member is supported on the oscillation shaft. If the above-described oscillating period is long, the body is not suddenly turned in direction and the body's part to which the largest weight is applied can be changed.

When a bed sheet or the like is replaced, the oscillation motor is turned on to incline the bedding support platform through a predetermined angle and then stopped. The sleeper's body can thereby be easily oscillated toward the inclined lower side of the bed, so that the sheet on the inclined upper portion may be replaced. Then, the switch is turned on to reversely incline the bedding support platform. After an operation similar to that described above is performed, the bedding support platform is returned to a horizontal position.

DETAILED DESCRIPTION OF PREFERRED EMBODIMENTS

Figure 1:
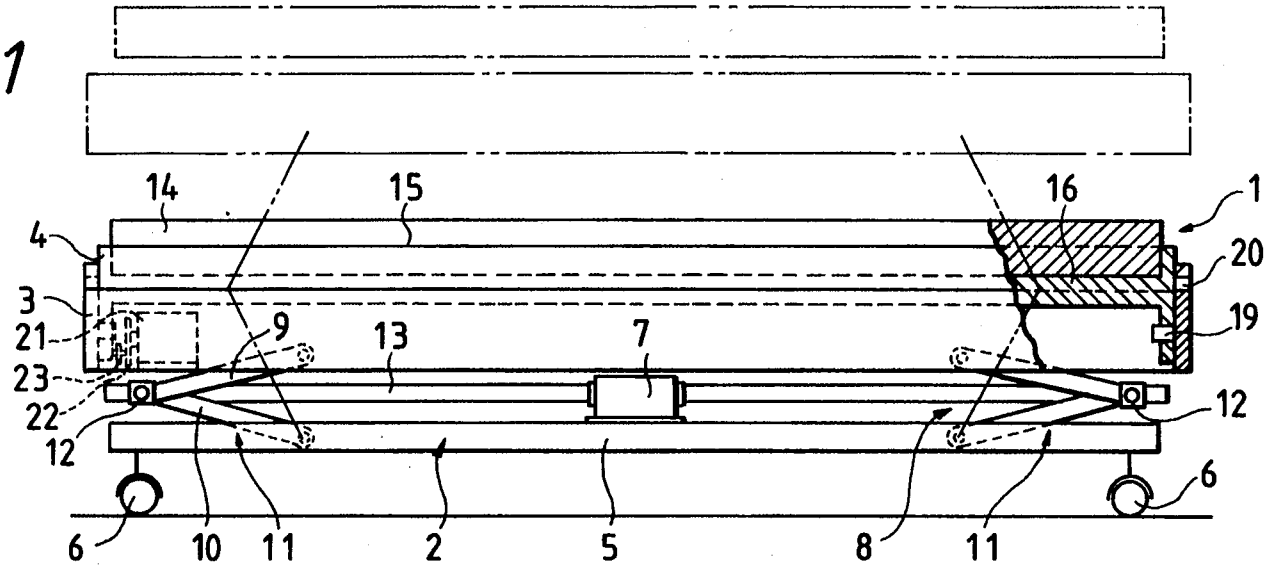
FIG. 1 is a side view showing a bed according to the present invention.
Figure 2:
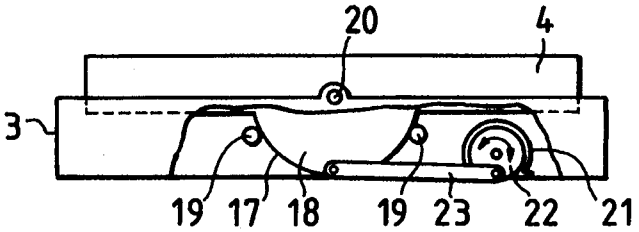
FIG. 2 is a partial front view of the bed in FIG. 1 and partly cut out.

One embodiment of a bed according to the present invention will be described hereinbelow with reference to the drawings.

A bed 1 according to the present invention comprises a stationary frame 3 supported on a base 2, and a bedding support platform 4 supported on the stationary frame 3 for oscillation. The base 2 can be moved freely by mounting, as necessary, castors 6 on a frame 5 formed into a suitable planar shape such as square or an H-shape. A lifting motor 7 is provided to move the stationary frame 3 up and down. The stationary frame 3 is constructed by forming plate-like members of a suitable height into a rectangular form, and supported on the frame 5 of the base 2.

The stationary frame 3 and the frame 5 are integrally connected through a lifting device 8. The lifting device 8 may be of any suitable construction. In the illustrated example, a lifting device 8 is provided on both the left and right ends of the frame 5, and a pantograph 11 consisting of two arms 9 and 10 is provided. A connecting member 12 for bendably connecting the arms 9 and 10 of the pantograph 11 is formed with internal threads (not shown). A screw shaft 13 is provided through the connecting members 12 of the left and right pantographs 11. The screw shaft 13 may be either integrally connected with the motor shaft of the lifting motor 7 of the stationary frame 3, or may be connected to the motor shaft of the lifting motor 7 through a power transmission mechanism. The left end of the screw shaft 13 has grooves threaded therein at the part fitted into the left side connecting member 12. The right end of the screw shaft 13 has oppositely thereaded grooves therein at the part fitted into the right side connecting member 12.

The bedding support platform 4 comprises a frame body 15 and a platform body 16 on which bedding such as a mattress 14 can be placed. The platform body 16 used may be a plate spring-like or a board-like configuration. A head portion and a foot portion of the frame body 15 include a supporting member 18 having a circular edge 17. The supporting member 18 is placed on a pair of receiving rolls 19 which are provided on the side plate at the head portion and foot portion of the stationary frame 3, respectively, and is supported by an oscillation shaft 20 fixed on the side plate at the head portion and foot portion of the stationary frame 3 so that the supporting member 18 is positioned on the center axis of the bed to thereby support the bedding support platform 4 on the stationary frame 3 for oscillation.

Reference numeral 21 designates an oscillation motor for imparting oscillating motion to the bedding support platform 4. A connector 23 is connected between a disk 22 provided on the motor shaft and the supporting member 18, whereby rotation of the oscillation motor 21 imparts oscillating motion to the bedding support platform 4. The oscillation angle is preferably on the order of 10° to the left and right. This angle can be changed by changing the securing position of the connecting rod 23 with respect to the disk 22, or by rotating the oscillation motor 21 through a predetermined angle to automatically stop or reversely roll it. Further, this enables the retention of stop at a suitable angle within the designated maximum oscillation angle. The above-described operation is carried out turning on/off the push-button of the oscillation motor 21. The bedding support platform 4 may be continuously oscillated by the continuous rotation of the oscillation motor 21 in the same direction or may be discontinuously oscillated by stopping the rotation of the motor 21 when the bedding support platform inclines at a predetermined angle.

The bed of the present invention can be used in the mode of a cradle which continuously repeats the oscillation in the following manner. The securing position of the connecting rod 23 with respect to the disk 22 is set at a predetermined oscillation angle. When the oscillation motor 21 is rotated, the drive force thereof is transmitted to the supporting member 18 through the disk 22 and the connecting rod 23. The bedding support platform 4 repeats the oscillating motion about the oscillation shaft 20 with the circular edge 17 of the supporting member 18 supported by the receiving rolls 19. The sleeper thereby receives a pleasant stimulus and can sleep well. At this time, the weight of the bedding support platform 4 is supported by two receiving rolls 19 holding the circular edge 17 of the supporting member 18. Since the two receiving rolls 19 are positioned away from the oscillation shaft 20, the bedding support platform 4 is prevented from being moved unstably at the time of oscillation.

In a case where the body of a person in a bed according to the present invention is turned, the bedding support platform 4 is not continuously oscillated but the rotation of the motor 7 is stopped at a predetermined angle to incline the bedding support platform 4. A helper is positioned at the lower portion of the inclined bedding support platform 4 to perform the operation by which the body is turned.

In the above-described operation, when the height of the bed is not suitable, the lifting motor 7 is suitably rotated to rotate the screw shaft 13. Then, the screw shaft 13 causes the pantographs 11 at opposite ends to simultaneously move up and down, since the opposite ends thereof have reversed threads, to move the stationary frame 3 up or down.

Of course, the upward or downward movement of the stationary frame can be suitably effected according to the physique of a bed user.

According to the bed of the present invention, the bedding support platform for supporting the bedding such as a mattress is provided for oscillation, by the oscillation shaft arranged along the sleeper's body, on the stationary frame vertically movably supported. Therefore, when the sleeper's body is turned, or when a bed sheet is replaced or the like, the bedding support platform can be inclined in one direction, and the above-described operation can be easily performed.

Further, the bedding support platform can be continuously oscillated to impart a cradle-like effect to the sleeper. Moreover, by the long-period comfortable oscillation, the body touches the bedding to enable the change of a position of the body to which large load is applied, thus providing an anti-bedsore effect.

What is claimed is:

1. A bed, comprising:

a base, a stationary frame, a lifting device for supporting the stationary frame on the base, a bedding platform supported on the stationary frame, the bedding platform having a central axis, an oscillation shaft provided substantially along the central axis of the bedding platform, and oscillation means for oscillating the bedding platform about the oscillation shaft with respect to the stationary frame.

2. A bed, comprising:

a base, a stationary frame, a lifting device for supporting the stationary frame on the base, a bedding platform supported on the stationary frame, the bedding platform having a head portion, a foot portion, and a central axis, an oscillation shaft provided substantially along the central axis of the bedding platform, and oscillation means for oscillating the bedding platform about the oscillation shaft with respect to the stationary frame, the oscillation means comprising:

at least one supporting plate having a circular edge, the at least one supporting plate being provided at at least one of the head portion and the foot portion of the bedding platform, a pair of mutually spaced rollers supported on the stationary frame for contacting and supporting the circular edge of the at least one supporting plate, and drive means for oscillating the supporting plate about the oscillation shaft.

3. The bed of claim 2, wherein the drive means comprises a motor having a shaft, a disk provided on the shaft of the motor, and a connector for connecting the disk to the supporting member.

* * * * *